US005871294A

United States Patent [19]

Turner

[11] Patent Number: 5,871,294

[45] Date of Patent: Feb. 16, 1999

[54] FELT TIP PEN COVER WITH ERASER

[75] Inventor: Patricia Turner, Itasca, Ill.

[73] Assignee: Chelsea Group Ltd., Itasca, Ill.

[21] Appl. No.: 844,937

[22] Filed: Apr. 23, 1997

Related U.S. Application Data

[63] Continuation-in-part of Ser. No. 586,990, Jan. 16, 1996, abandoned.

[51] Int. Cl.[6] ..... B43K 25/00; B43K 5/00

[52] U.S. Cl. ..... 401/52; 401/202

[58] Field of Search ..... 401/196, 202, 401/213, 124, 98, 52, 34

[56] References Cited

U.S. PATENT DOCUMENTS 134,215 12/1872 Morse ..... 15/427
4,543,680 10/1985 Vlahos ..... 15/145
4,937,910 7/1990 Frazier ..... 15/231
5,072,483 12/1991 Durand ..... 401/202 X

*Primary Examiner*—Robert A. Hafer
*Assistant Examiner*—D. Neal Muir
*Attorney, Agent, or Firm*—Clifford Kraft

[57] ABSTRACT

A felt tip pen cover with an attached eraser or a felt tip pen with an eraser on its bottom. The present invention places an eraser on or near the end of the cover that is inserted into the bottom of the pen or on the bottom of pen itself. For a tapered cover type of pen, the eraser is placed on the flat upper end. For a raised or dimple type of cover, the eraser is placed concentrically around the end away from the dimple like a girdle or belt or flat on the bottom of the pen body. On a type of pen that resembles a fountain pen, the eraser is placed on top cover on a flat area that may be slightly angled. The eraser can also be an annular ring on the base of the pen body. The addition of an eraser to a felt tip pen leads to the novel ability to erase and make corrections without having to search for a large eraser.

9 Claims, 4 Drawing Sheets

FELT TIP PEN COVER WITH ERASER

This is a Continuation-In-Part of application Ser. No. 08/586,990 filed Jan. 16, 1996, now abandoned.

BACKGROUND

1. Field of the Invention

This invention relates generally to the field of writing instruments and more particularly to felt tip pens and covers for felt tip pens used to write on whiteboard material where these pens and pen covers are equipped with an eraser.

2. Description of the Related Art

Previous systems comprise several major types of felt tip pens and covers. One type consists of a small circular raised area on the top of the cover for insertion into the bottom of the pen when the pen is in use; a second type consists of a tapered cylindrical cover that is reversed and inserted into the bottom of the pen when the pen is in use. A third type of felt tip marker resembles a fountain pen. This type has a removable cover that is inserted over the base of the pen when writing.

None of these previous systems is equipped with any type of eraser. Yet, numerous circumstances arise during the use of a felt tip pen at a whiteboard where a minor correction is required. Erasing the dried ink from the board requires searching for a full sized board eraser. This means picking up the large eraser with a second hand and erasing while still holding the pen in the first hand.

Sometimes a large eraser cannot be found. Either the room containing the whiteboard was not equipped with one, or it has been misplaced. In this case, the lecturer must generally wipe the colored ink from the board with his or her hand or palm. In either case, the colored ink is transferred to the skin causing a mess that can then accidently be transferred to clothing or elsewhere.

What is very badly needed is a felt tip pen with an eraser on its cover or elsewhere. This eraser need not be large since it would not necessarily be used to erase an entire board, but rather to simply make corrections.

SUMMARY OF THE INVENTION

The present invention relates to an improved felt tip pen cover with an attached eraser. The invention places an eraser on the end of the cover that is not inserted into the bottom of the pen or on the end of the pen body.

For the tapered cover type of pen, the eraser is placed on the flat upper end. For the raised or dimple type, the eraser is placed concentrically around the end away from the dimple like a girdle or belt. This is necessary since that end is also used to cover the felt wick. The third type of pen resembles a fountain pen. Here the eraser is placed on the top of the cover on a flat area that may be angled slightly. An alternative is to place an annular eraser on the flat bottom of the raised or dimple type. The eraser resembles a flat doughnut on the end of the pen. The hole in the center of the eraser allows insertion of the pen cover into the base of the pen in the normal way.

Another embodiment of the present invention places the eraser as an annular ring on the bottom of the pen body. Here, the cap is simply inserted into the pen base through the center of the eraser. The eraser is used when the cover is on the pen.

BRIEF DESCRIPTION OF THE DRAWINGS

For a more complete understanding of this invention, reference should now be made to the embodiments illustrated in greater detail in the accompanying drawings and described below by way of examples of the invention.

It should be understood, of course, that the invention is not necessarily limited to the particular embodiments illustrated herein.

DESCRIPTION OF PREFERRED EMBODIMENTS

Figure 1:
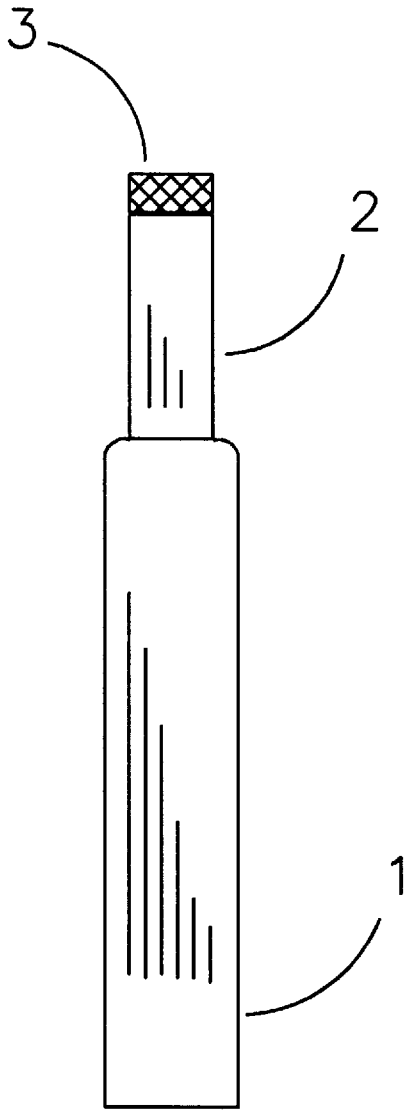
FIG. 1 shows the tapered type of pen cover with the eraser mounted on the top of the cover.

Turning to FIG. 1, one of the major types of pens manufactured today can be seen. There is a cylindrical body 1, and a cylindrical cap 2. The cap 2 is tapered slightly at its base (taper not shown) so that the tapered end can be inserted into the bottom of the body 1. The body 1 contains ink and a wick that extends out the top of the pen (not shown).

FIG. 1 shows an embodiment of the invention with a pad or layers of pliable material 3 mounted on the top of the cap 2 to form an eraser. This material 3 can be felt or any other layered or non-layered material that can be used to erase a whiteboard. This eraser pad can be glued, epoxied, superglued, or attached by any other manner that causes it to be firmly affixed. The eraser material can be impregnated with a organosilicone fluid, if desired, to enhance dust retention.

When the pen is in the writing position with the cap stuck into the bottom, the eraser faces out the back of the pen. This is a very convenient position for the eraser since the user needs only turn the hand slightly to erase or make small corrections.

Figure 2A:
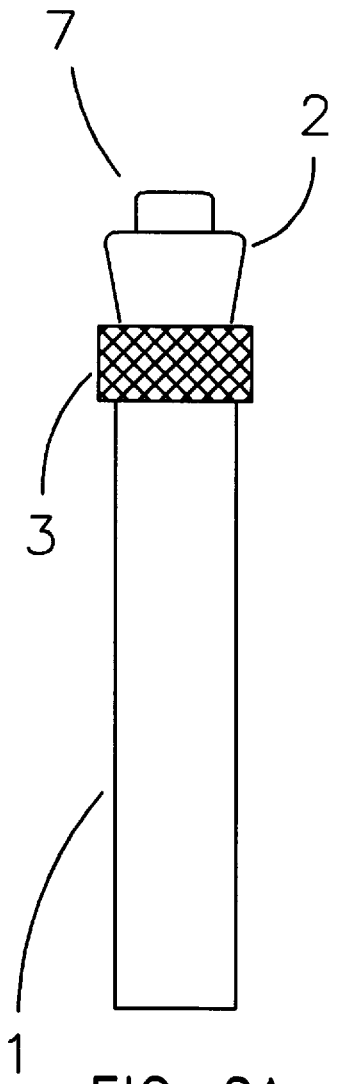
FIG. 2 shows the dimple type of pen cover with the eraser mounted concentrically around the bottom of the cover.
Figure 2B:
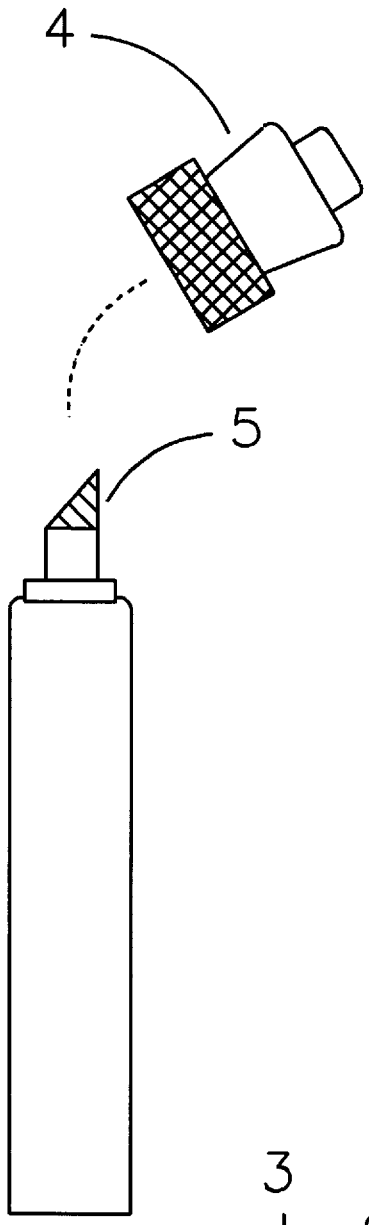
Figure 2C:
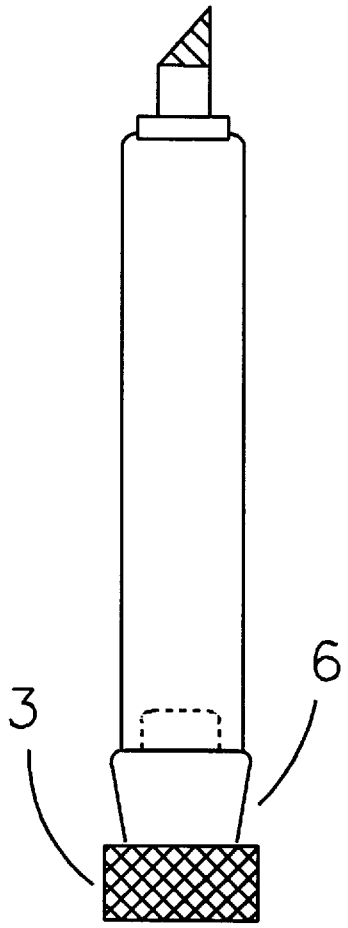

FIG. 2 shows another major type of felt tip pen on the market. There is a generally cylindrical body 1, and a cap or cover 2. In this case, the cover 2 contains a small circular raised area or dimple 7. This dimple 7 is used to hold the cap in the bottom of the body 1 in the writing position as can be clearly seen in FIG. 2. The body 1 contains ink and a wick which protrudes out the top of the body to form a writing surface 5. The cap 2 is removed from the pen body 1 when it is desired to write. The cap is moved 4 from the top of the pen to the bottom with the dimple inserted body. The cap in this position 6 is firmly held to the pen body.

An embodiment of the present invention places an eraser pad 3 made of felt or other suitable material concentrically around the bottom of the cover 2. The pad 3 forms a belt or girdle around the cover 2. When the cover is place in the bottom of the base 6 for writing, the eraser pad 3 is exposed and in position to erase.

Figure 3:
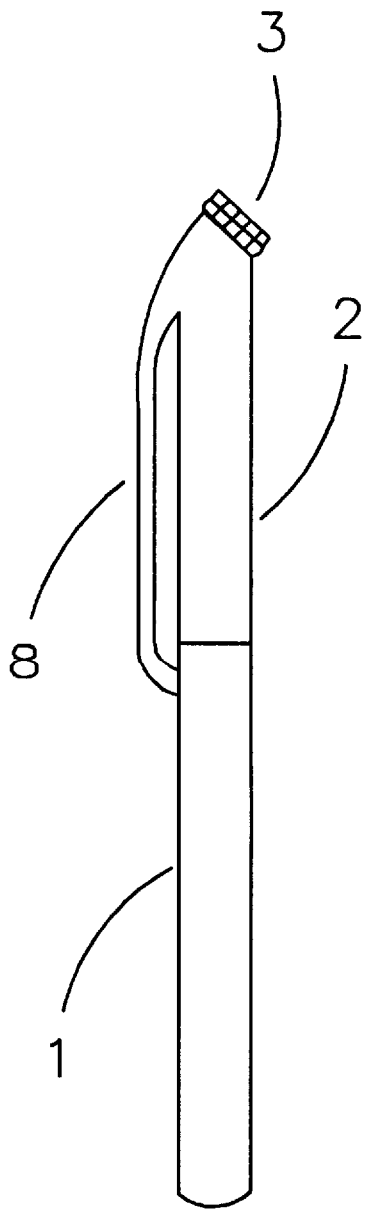
FIG. 3 shows the fountain pen type of pen cover with the eraser mounted on the top of the cover.

FIG. 3 shows a third type of pen found on the market, namely one that resembles a fountain pen (with possibly a larger diameter). Here again there is a cylindrical body 1 and a cap or cover 2. There is a pocket clip 8 as well. Due to the position and shape of the pocket clip 8, the eraser pad 3 is positioned on an angled flat portion on the top of the cover 2. In the writing position, the cover 2 is placed over the bottom of the body 1, exposing the eraser pad 3 for erasing.

Figure 4A:
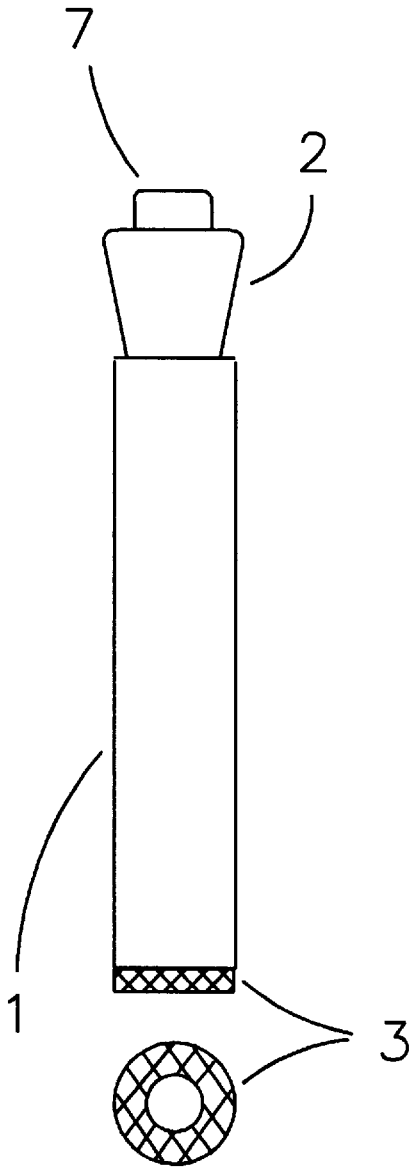
FIG. 4 shows the dimple type pen of FIG. 2 with an annular eraser mounted on the bottom of the pen.
Figure 4B:
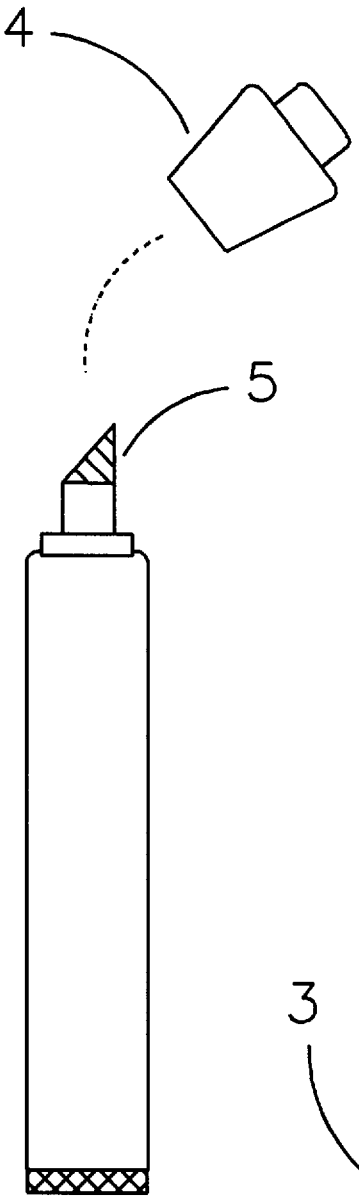
Figure 4C:
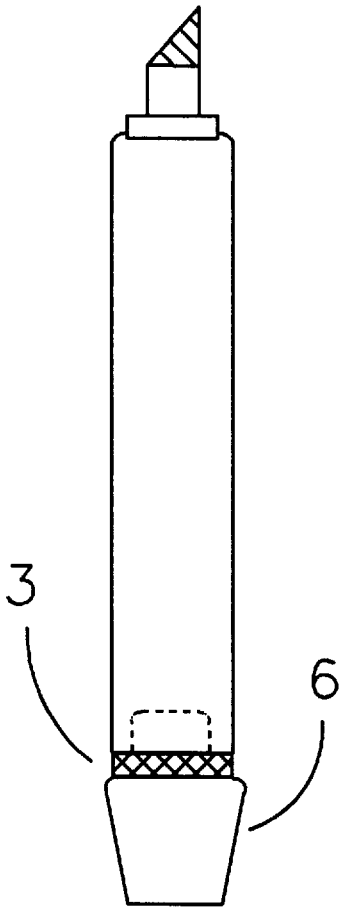

FIG. 4 shows the type of pen of FIG. 2, where the dimple type cap 2 is inserted into the bottom of the pen when writing 6. In this embodiment, a substantially flat annular ring of eraser material 3 is firmly attached by glue or any other method that would firmly attach it to the bottom of the pen body 1. The hole in the eraser 3 allows the cap 6 to still be inserted into the bottom of the pen body when writing. This embodiment offers the advantage of having the eraser on the back of the pen. In this position, it may be more convenient to use the present invention to erase or correct material on the writing surface.

The manner of attachment of the pad is relatively unimportant as long as the pad cannot move. The pad can be dry or permanently wetted. It can be untreated, or can contain anti-electrostatic material. The best choice for material is felt; however, any pliable material can be used.

The exact shape of the eraser pad is also not important as long as enough surface area is exposed to erase marks on the board. The mounting positions shown in FIGS. 1–4 are merely representative of the present invention and can be altered without major effect. The eraser pad 3 can be mounted anywhere on the cover or body of the pen and still be effective. The present invention can be embodied with any type of pen on the market, and any type that may come onto the market since the eraser can be attached anywhere.

It is to be understood that the above-described arrangements are merely illustrative of the application of the principles of the invention, and that other arrangements may be devised by those skilled in the art without departing from the spirit and scope of the invention.

What is claimed is:

1. An improved felt tip marker pen with a writing end and a non-writing end of the type used to mark whiteboards in which a removable cap covers a pen tip when the pen is not being used and the removable cap is inserted into a bottommost aperture in a pen body when the pen is being used, wherein the improvement comprises: a substantially flat annular eraser pad of pliable material attached to the non-writing end of said pen, whereby the said removable cap can be inserted through said annular eraser pad, said eraser pad being used to erase marks on a whiteboard.

2. The invention claimed in claim 1 wherein said annular eraser pad is felt.

3. The invention claimed in claim 1 wherein said annular eraser pad is glued to the non-writing end of said pen.

4. A felt tip marker pen used for marking whiteboards comprising:

a substantially cylindrical elongated pen body with a first and second end, said first end containing a writing tip for writing on a whiteboard; said second end forming a base, said base having a substantially cylindrical aperture in which a pen cap is inserted when said pen is in use;

a substantially flat annular eraser pad attached to said base wherein said pen cap is inserted through said annular eraser pad, said annular eraser pad used to erase marks on said whiteboard.

5. The felt tip marker pen of claim 4 wherein said annular eraser pad is felt.

6. The felt tip marker pen of claim 4 wherein said annular eraser pad is glued to said elongated pen body.

7. A felt tip pen for marking whiteboards comprising:

a cylindrical body with a writing tip and a base;

means on said base for inserting a cap when said pen is in use;

an annular eraser pad means for erasing marks on whiteboards attached to said base, whereby said cap is inserted through said annular eraser pad.

8. The felt tip pen of claim 7 wherein said annular eraser pad is felt.

9. The felt tip pen of claim 7 wherein said annular eraser pad is glued to said base.

* * * * *